United States Patent [19]

Soga

[11] 4,046,517

[45] Sept. 6, 1977

[54] CEMENTED CARBIDE MATERIAL FOR CUTTING OPERATION

[75] Inventor: Yasuyuki Soga, Kobe, Japan

[73] Assignee: Ltd. Dijet Industrial Co, Osaka, Japan

[21] Appl. No.: 582,334

[22] Filed: May 30, 1975

[30] Foreign Application Priority Data

Feb. 14, 1975 Japan ..... 50-18981

[51] Int. Cl.[2] ..... C22C 29/00; C04B 35/56; C04B 35/58

[52] U.S. Cl. ..... 428/539.9; 106/43; 51/307; 51/309 R

[58] Field of Search ..... 106/43; 75/203, 204, 75/176; 29/182.7, 182.5; 51/309, 307

[56] References Cited

U.S. PATENT DOCUMENTS

| | | | |
|---|---|---|---|
| 2,568,251 | 9/1951 | Oswald | 106/43 |
| 3,245,763 | 4/1966 | Ohlsson et al. | 29/182.7 |
| 3,490,901 | 1/1970 | Hachisuka | 106/43 X |
| 3,525,999 | 8/1970 | Benesovsky et al. | 29/182.7 |
| 3,679,442 | 7/1972 | Bergna | 29/182.7 |
| 3,703,368 | 11/1972 | Rudy | 75/175.5 |
| 3,708,355 | 1/1973 | Rudy | 75/176 |
| 3,737,289 | 6/1973 | Rudy | 75/204 |
| 3,746,517 | 7/1973 | Yamaya et al. | 29/182.7 |
| 3,752,655 | 8/1973 | Ramquist | 29/182.7 |

OTHER PUBLICATIONS

Kieffar, R. et al., "Nitrides and Carbonitrides and Nitride-Based Cemented Hand Alloys," Chemical Abstracts, vol. 76, 1972, 17124k.

*Primary Examiner*—Winston A. Douglas
*Assistant Examiner*—Mark Bell
*Attorney, Agent, or Firm*—Frank J. Jordan

[57] ABSTRACT

Cemented carbide material comprising 10 to 60% by weight of tungsten carbide, 5 to 40% by weight of titanium carbide, 5 to 30% by weight of tantalum carbide, 3 to 20% by weight of titanium nitride and 5 to 20% by weight of an iron family metal such as cobalt, nickel or iron. The cemented carbide material may further contain 5 to 20% by weight of molybdenum and/or molybdenum carbide. The material is excellent in heat resistance, wear resistance, hardness and toughness and is adapted for a wide variety of cutting conditions.

11 Claims, 7 Drawing Figures

CEMENTED CARBIDE MATERIAL FOR CUTTING OPERATION

BACKGROUND OF THE INVENTION

Figure 1A:
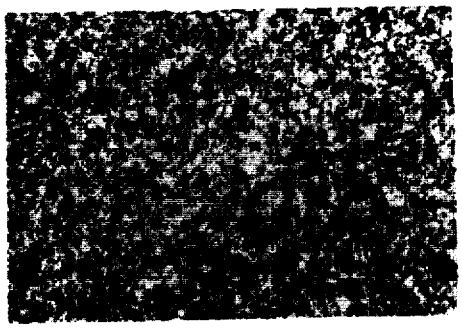

This invention relates to cemented carbide materials for use in milling, turning and like cutting operations.

Usual cemented carbides for a cutting operation such as milling include tungsten carbide grades and titanium carbide grades. Tungsten carbide grades have the drawback of being more susceptible to crater wear than titanium carbide bases. To remedy this drawback, titanium carbide is added to tungsten carbide, but with the increase in the proportion by weight of titanium carbide used, the flexural strength of the cemented carbides obtained decrease. Furthermore, as compared with titanium carbide grades, tungsten carbide grades are markedly low in wear resistance when cutting steel and are prone to formation of a built-up edge, so that they are usable only under limited cutting conditions.

On the other hand, titanium carbide-base materials are widely used for high-speed cutting because they have higher hardness and more excellent heat resistance than tungsten carbide bases, but they are lower in toughness and less resistant to mechanical impact as well as to thermal impact than tungsten carbide grades. Titanium carbide grades, in addition, have lower thermal conductivity than tungsten carbide grades. When the cutting edge of titanium carbide-base material is locally heated during cutting, the edge cracks and may possibly be broken when rapidly cooled. Furthermore, when used at high speeds above a certain level or during heavy cutting, such cutting edge is prone to breakage due to the thermal stress. Because of these drawbacks, it is difficult to use titanium carbide grades for operations other than light cutting.

Thus tungsten carbide grades and titanium carbide grades have inherent drawbacks and are therefore serviceable under considerably limited cutting conditions.

SUMMARY OF THE INVENTION

An object of this invention is to provide a cemented carbide material for cutting operations having excellent heat resistance.

Another object of this invention is to provide a cemented carbide material for cutting operations which is highly resistant to wear such as flank wear and crater wear.

Another object of this invention is to provide a cemented carbide material for cutting operations having high flexural strength and high hardness.

Another object of this invention is to provide a cemented carbide material for cutting operations having high resistance to mechanical and thermal impacts.

Still another object of this invention is to provide a cemented carbide material for cutting operations adapted for use under a wide variety of cutting conditions involving low to high cutting speeds as in a milling operation, irrespective of whether used in a dry or a wet method.

The cemented carbide material of this invention comprises 10 to 60% by weight of tungsten carbide, 5 to 40% by weight of titanium carbide, 5 to 30% by weight of tantalum carbide, 3 to 20% by weight of titanium nitride and 5 to 20% by weight of an iron family metal such as cobalt, nickel or iron. The cemented carbide material may further contain 5 to 20% by weight of molybdenum and/or molybdenum carbide.

DESCRIPTION OF THE INVENTION

The cemented carbide material having the foregoing composition is more resistant to heat than conventional titanium carbide grades, has increased hardness while substantially retaining the desired flexural strength and is adapted for a wide variety of cutting conditions.

As a tool material for cutting steel or high-grade cast iron, titanium carbide is most useful in reducing the flank wear and crater wear to be encountered. As far as wear is concerned, therefore, it is advantageous to increase the proportion of titanium carbide to the greatest possible extent, whereas the very low thermal conductivity of titanium carbide may give rise to various problems. To assure effectiveness of titanium carbide material, tungsten carbide, tantalum carbide, niobium carbide, etc. are usable in the form of a solid solution. For exammple, a preferably solid solution consists of tungsten carbide, titanium carbide and tantalum carbide in the ratio of 5:3:2 or 5:2:3. Usually, such solid solution is admixed with tungsten carbide, tantalum carbide, niobium carbide, cobalt, nickel, iron, etc. to prepare the desired composition, which is then sintered. However, when the volume proportion of titanium carbide in the composition is in excess of a certain level, portions of the titanium carbide-containing solid solution in contact with each other tend to fuse together to produce large particles during sintering, however thoroughly the composition may be mixed. The size of the enlarged particles is a critical factor which influences tool wear, so that it is desired that the titanium-containing solid solution have a small particle size.

When added in a suitable amount to the composition, titanium nitride suppresses the growth of the particles. More specifically, titanium nitride permits formation of the peculiar structure of titanium carbide-base cemented carbide material in which titanium carbide serves as nuclei, inhibiting the growth of solid solution particles which is predominant with titanium carbide and thereby ensuring formation of fine crystalline particles. As compared with titanium carbide, moreover, titanium nitride has higher resistance to thermal impact and entails reduced heat generation because of its lower coefficient of friction relative to steel. Consequently, the cemented carbides incorporating titanium nitride have higher resistance to thermal impact than usual titanium carbide grades. Use of titanium nitride which assures formation of fine particles gives increased hardness and greatly improved wear resistance to the material obtained. Thus, the material exhibits high cutting performance with a relatively low titanium content and is less susceptible to cracking or chipping when used in a milling operation whether the operation is by a wet or the usual dry method.

Preferably, the amounts of titanium carbide and titanium nitride to be used are in the foregoing ranges. With larger amounts, the toughness will decrease, whereas with smaller amounts, the resulting material will not be fully satisfactory in its resistance to heat and wear.

As described above, tantalum carbide is used to ensure effectiveness of titanium carbide incorporated in the cemented carbide material. Since tantalum is difficult to separate from niobium by smeltering, niobium is generally coexistent with tantalum, whilst the properties of the solid solution thereof is not noticeably different from those of tantalum carbide. Accordingly, the term "tantalum carbide" as used in the appended claims is to be interpreted as including tantalum carbide which is partially replaced by niobium carbide.

With high titanium carbide contents, molybdenum or molybdenum carbide ($Mo_2C$) is effective in suppressing the growth of particles as is well known. Although titanium nitride is singly useful if it is desired only to suppress the growth of particles, use of 5 to 20% of molybdenum or molybdenum carbide is found to give a material which is very advantageous as a tool material for milling which is an intermittent cutting operation. When molybdenum is not used, the resulting material is useful in a turning operation that is a continuous cutting operation.

EXAMPLE 1

Figure 1B:
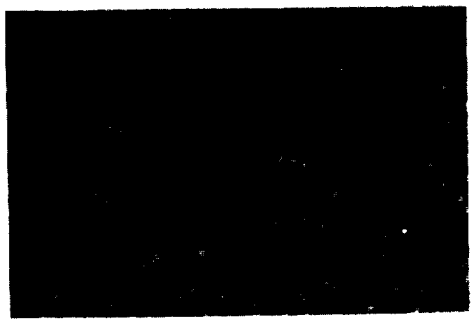
Figure 1C:
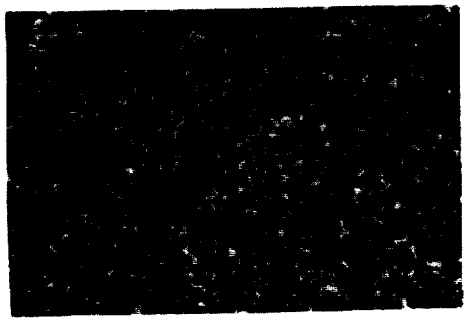
Figure 2A:
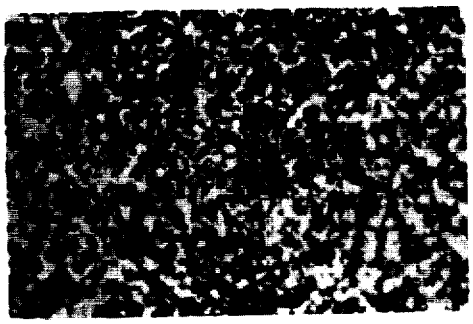
Figure 2B:
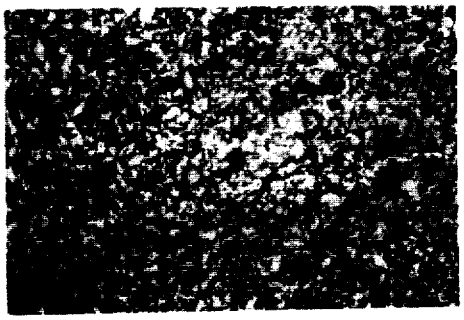
Figure 2C:
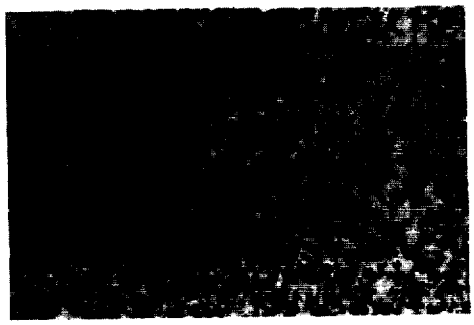
Figure 2D:
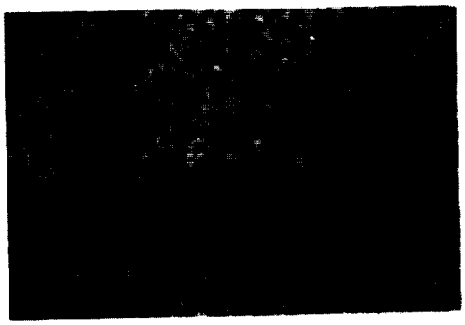

Tungsten carbide, titanium carbide, tantalum carbide, titanium nitride, molybdenum carbide and iron family metals serving as binders were used in the proportions listed in Table 1 below. The compositions were each thoroughly mixed for about 48 hours in a stainless steel ball mill, using cemented carbide balls, pressed for shaping and sintered at 1,400° C or 1,450° C to obtain tool tips. The tips were tested for flexural strength and hardness. The results are given in Table 1. Also FIGS. 1(A) to 1(C) microscopically show the structures of listed Samples No. 5 to No. 7, respectively, at a magnification of 1,500X. These results indicate the tips are very compact in structure and excellent in flexural strength and in hardness.

Table 1

| Sample No. | 1 | 2 | 3 | 4 | 5 | 6 | 7 |
|---|---|---|---|---|---|---|---|
| Composition (wt. %) | | | | | | | |
| WC | 15 | 20 | 15 | 53 | 20 | 15 | 10 |
| TiC | 40 | 35 | 40 | 20 | 40 | 40 | 40 |
| TaC | 5 | 10 | 5 | 5 | 5 | 5 | 10 |
| TiN | 10 | 5 | 10 | 5 | 10 | 10 | 10 |
| Ni | 5 | 15 | 15 | — | 10 | 15 | 15 |
| Co | 10 | — | — | 12 | — | — | — |
| $Mo_2C$ | 15 | 15 | 15 | 5 | 15 | 15 | 15 |
| Sintering temperature (° C) | 1,400 | 1,400 | 1,400 | 1,450 | 1,400 | 1,400 | 1,400 |
| Hardness ($H_{RA}$) | 91.7 | 90.9 | 92.1 | 91.9 | 92.3 | 92.1 | 91.4 |
| Flexural strength (kg/mm²) | 130 | 135 | 120 | 118 | 119 | 120 | 131 |

EXAMPLE 2

In substantially the same manner as in Example 1, cemented carbide tool tips were prepared without using molybdenum carbide, and the tips were similarly tested. FIGS. 2(A) to 2(D) microscopically show the structures of listed Samples No. 8 to No. 11, respectively, at a magnification of 1,500X. The tips were found to be very compact in structure and excellent in flexural strength and in hardness.

Table 2

| Sample No. | 8 | 9 | 10 | 11 |
|---|---|---|---|---|
| Composition (wt. %) | | | | |
| WC | 24 | — | 59 | 60 |
| TiC | — | — | 20 | 12 |
| TaC | — | — | 5 | 15 |
| WC:TiC:TaC 5 3 2 | 60 | 80 | — | — |
| TiN | 5 | 6 | 5 | 3 |
| Ni | 7 | 9 | — | 3 |
| Co | 4 | 5 | 11 | 7 |
| Sintering temperature (° C) | 1,400 | 1,400 | 1,400 | 1,400 |
| Hardness ($H_{RA}$) | 92.3 | 92.0 | 92.0 | 92.6 |
| Flexural strength (kg/mm²) | 152 | 154 | 158 | 183 |

Note:
Sample No. 11 was prepared by vacuum sintering and subsequent hot treatment by compression under hydrostatic pressure.

EXAMPLE 3

Substantially in the same manner as in Example 1, tool tips were produced, and the tips were tested for mechanical properties and cutting performance. For comparison, tips made of conventional materials were similarly tested. Table 3 shows the results, which reveal that the samples of this invention have excellent mechanical properties and exhibit outstanding cutting performance.

Table 3

| Sample | This invention No. 12 | Conventional* | This invention No. 5 | Conventional* |
|---|---|---|---|---|
| Composition (wt. %) | | | | |
| WC | 45 | | 20 | |
| TiC | 18 | | 40 | |
| TaC | 12 | | 5 | |
| TiN | 5 | | 10 | |
| Ni | 7 | | 10 | |
| Co | 4 | | — | |
| $Mo_2C$ | 9 | | 15 | |
| Flexural strength (kg/mm²) | 171 | 135 | 119 | — |
| Hardness ($H_{RA}$) | 92.2 | 91.8 | 92.3 | 91.0 |
| Flank wear after cutting ($V_B$ in mm, average) | | | | |
| Test 1 | 0.07 | 0.12 | — | — |
| Test 2 | — | — | 0.131 | 0.169 |

*Sample in conformity with U.S.A. Industrial Code C-7.

Note 1: Cutting conditions

| | Test 1 (Turning) | Test 2 (Milling) |
|---|---|---|
| Blank (annealed) | AISI W-1 | AISI D-2 |
| Cutting speed (m/min) | 136 | 113 |
| Feed (mm/rev) | 0.35 | 0.208/edge |
| Depth of cut (mm) | 1.5 | 1.5 |
| Cutting time (min) | 21 | 10 |

Note 2: Tool shape
Front-relief angle: 6°, front rake angle: − 6°.

Table 3-continued

| |
|---|
| front-cutting edge angle: 30°, side-relief angle: −6°, side rake angle: 6°, side-cutting edge angle: 0°. |
| Note 3: Shape of milling cutter Radial rake angle: −6°, axial rake angle: −12°, lead angle: 15°, nose radius: 0.4 mm. |

As will be apparent from the foregoing description, the present invention provides cutting-tool cemented carbide materials having excellent resistance to wear and to thermal impact, enhanced in hardness without substantially sacrificing flexural strength, improved in resistance to flank wear and usable in dry and wet cutting methods.

What is claimed is:

1. A cemented carbide material for cutting operations consisting essentially of 10 to 60% by weight of tungsten carbide, 5 to 40% by weight of titanium carbide, 5 to 30% by weight of tantalum carbide, 3 to 20% by weight of titanium nitride and 5 to 20% by weight of an iron family metal selected from the group consisting of cobalt, nickel and iron.

2. A cemented carbide material for cutting operations consisting essentially of 10 to 60% by weight of tungsten carbide, 5 to 40% by weight of titanium carbide, 5 to 30% by weight of tantalum carbide, 3 to 20% by weight of titanium nitride, 5 to 20% by weight of an iron family metal selected from the group consisting of cobalt, nickel and iron and 5 to 20% by weight of at least one of molybdenum and molybdenum carbide.

3. A cemented carbide material for cutting operations consisting essentially of 10 to 60% by weight of tungsten carbide, 5 to 40% by weight of titanium carbide, 5 to 30% by weight of tantalum carbide, 3 to 20% by weight of titanium nitride and 10 to 15% by weight of an iron family metal selected from the group consisting of cobalt, nickel and iron.

4. A cemented carbide material for cutting operations consisting essentially of 10 to 60% by weight of tungsten carbide, 5 to 40% by weight of titanium carbide, 5 to 30% by weight of tantalum carbide, 3 to 20% by weight of titanium nitride, 5 to 20% by weight of an iron family metal selected from the group consisting of cobalt, nickel and iron and 9 to 15% by weight of at least one of molybdenum and molybdenum carbide.

5. A cemented carbide material for cutting operations consisting essentially of 10 to 60% by weight of tungsten carbide, 12 to 40% by weight of titanium carbide, 5 to 16% by weight of tantalum carbide, 3 to 10% by weight of titanium nitride and 10 to 15% by weight of at least one iron family metal.

6. A cemented carbide material for cutting operations consisting essentially of 10 to 60% by weight of tungsten carbide, 5 to 40% by weight of titanium carbide, 5 to 30% by weight of tantalum carbide, 3 to 20% by weight of titanium nitride, 10 to 15% by weight of an iron family metal selected from the group consisting of cobalt, nickel and iron and 5 to 20% by weight of at least one of molybdenum and molybdenum carbide.

7. A cemented carbide material for cutting operations consisting essentially of 10 to 60% by weight of tungsten carbide, 5 to 40% by weight of titanium carbide, 5 to 30% by weight of tantalum carbide, 3 to 20% by weight of titanium nitride, 10 to 15% by weight of an iron family metal selected from the group consisting of cobalt, nickel and iron and 9 to 15% by weight of at least one of molybdenum and molybdenum carbide.

8. A cemented carbide material for cutting operations consisting essentially of 10 to 60% by weight of tungsten carbide, 12 to 40% by weight of titanium carbide, 5 to 16% by weight of tantalum carbide, 3 to 10% by weight of titanium nitride, 10 to 15% by weight of at least one iron family metal and 9 to 15% by weight of at least one of molybdenum and molybdenum carbide.

9. A cemented carbide material as defined in claim 7 wherein the iron family metal is nickel.

10. A cemented carbide material as defined in claim 7 wherein the iron family metal is cobalt.

11. A cemented carbide material as defined in claim 7 wherein the iron family metals are nickel and cobalt.

* * * * *